United States Patent [19]

Kline

[11] 4,283,974

[45] Aug. 18, 1981

[54] BAR END DROPPER FOR FORGING MACHINES OR THE LIKE

[75] Inventor: Gaylen O. Kline, Tiffin, Ohio

[73] Assignee: The National Machinery Company, Tiffin, Ohio

[21] Appl. No.: 63,763

[22] Filed: Aug. 6, 1979

[51] Int. Cl.[3] ..... B26D 5/20

[52] U.S. Cl. ..... 83/42; 83/80; 83/104; 83/198; 83/208; 83/245; 83/280; 83/288; 83/364

[58] Field of Search ..... 83/42, 79, 80, 102, 83/104, 111, 123, 196, 198, 208, 244, 245, 262, 279, 280, 281, 282, 288, 356.2, 360, 363, 364, 367

[56] References Cited

U.S. PATENT DOCUMENTS

| | | | |
|---|---|---|---|
| 2,958,243 | 11/1960 | Foster | 83/364 X |
| 3,212,377 | 10/1965 | Bennett | 83/42 |
| 3,289,508 | 12/1966 | Sollanek | 83/104 X |
| 3,405,577 | 10/1968 | Cousino | 83/198 X |
| 3,466,958 | 9/1969 | Munson | 83/364 X |
| 3,552,163 | 1/1971 | Lloyd | 83/287 X |
| 3,972,211 | 8/1976 | Linthicum et al. | 83/104 X |
| 3,972,257 | 8/1976 | Lozar | 83/198 |
| 4,011,779 | 3/1977 | Berg | 83/364 X |

FOREIGN PATENT DOCUMENTS

| | | | |
|---|---|---|---|
| 1390021 | 4/1975 | United Kingdom | 83/42 |

*Primary Examiner*—Frank T. Yost
*Assistant Examiner*—Robert P. Olszewski
*Attorney, Agent, or Firm*—Pearne, Gordon, Sessions, McCoy & Granger

[57] ABSTRACT

A bar end dropper for forging machines or the like is disclosed which automatically operates to reject blanks cut from the end of the piece of stock which are of unsatisfactory length and to adjust the feed when necessary to ensure that the ends of pieces of stock being fed into the machine are a sufficient distance from the shear plane of the cutter to ensure a clean cutting operation. As sequential pieces of stock are fed to the machine, they are positioned in the measuring position and the measuring carriage moves in to position a sensor a distance from the shear plane determined by the length of the stock. This automatically positions the sensor. The sensor operates to sense the passage of the rearward end of the stock and determines (1) if the portion of the stock extending past the shear plane is of insufficient length to produce a usable blank and operates controls to cause automatic rejection of such piece or (2) that the ends of the pieces of stock will be an insufficient distance from the shear plane to produce a clean cut. In the latter event, the sensing assembly initiates a short feed operation to locate the interface between the two ends of stock a sufficient distance from the shear plane to ensure a proper cut.

16 Claims, 15 Drawing Figures

BAR END DROPPER FOR FORGING MACHINES OR THE LIKE

BACKGROUND OF THE INVENTION

This invention relates generally to feed systems for forging machines or the like, and more particularly to a novel and improved bar end dropper system which functions to automatically ensure that only satisfactory blanks are supplied to the machine for subsequent processing, without unnecessary scrap or waste.

PRIOR ART

Many machines, such as forging machines or the like, are provided with a cutter or shear which progressively cuts blanks or workpieces from the end of an elongated piece of stock and then transfers such workpiece to one or more work stations at which the blank is formed or shaped. When the abutting end of sequential pieces of stock approaches the cutter, unusable blanks which are too small may be produced, or if the end of the stock is too close to the shear plane of the cutter, the cutter may be unable to produce a clean and relatively square cut.

Generally in the past, the practice has been for the machine operator to watch for the movement of the ends of the stock to the cutter and to manually cause the transfer fingers to remain open so that unusable blanks are dropped and are not transferred to the work stations. Generally with such procedure, the operator causes the dropping of a series of blanks to be sure that he doesn't accidentally cause an unusable blank to be transferred into the machine. Consequently, an excessive number of blanks are often scrapped. Further, if the operator fails to drop an unusable blank, the dies can be damaged or costly jams can occur.

Further, if the end of the stock is too close to the shear plane, the cutter cannot in some instances, particularly with heated stock, produce a good cut and the pieces may have a burr, which can cause difficulty in ejecting the blank from the shear or cause overfilling of the dies at a subsequent work or processing station.

U.S. Pat. Nos. 3,289,508 and 3,972,211 (the latter of which is assigned to the assignee of the present invention) disclose automatic bar end dropping systems which operate to drop blanks cut from the end of the piece of stock, but the machines of such patents do not provide means to ensure that the end of the stock is far enough from the shear plane to ensure a satisfactory cutting operation. Further, such machines operate to drop several blanks, and thereby, in most instances, cause the loss of at least some satisfactory blanks.

SUMMARY OF THE INVENTION

A method and apparatus in accordance with the present invention provides measuring means which accurately measure the lengths of successive lengths of stock and which automatically and accurately position a sensor to determine the position of the approaching ends of pieces of stock with respect to the shear plane of the cutter. Such sensor operates through a control system to perform one of two operations, depending upon the position of the end of the stock with respect to the shear plane.

If the sensor determines that the ends of the stock will be spaced a sufficient distance from the shear plane to provide a satisfactory shearing operation, the sensor merely operates to cause the short pieces, or crop, to be dropped, but does not cause the dropping of any usable blanks. If, on the other hand, the sensor determines that with normal feeding the ends of the stock being fed will be so close to the shear plane as to cause an unsatisfactory cut on one or the other of the pieces of stock, the sensor operates to modify the stock feeding operation to locate the ends at a distance from the shear plane which will result in good cut. At the same time, the sensor causes the transfer to remain open for two cycles to drop all of the pieces of improper length. However, here again, no usable blanks are dropped and there is no unnecessary scrap.

In the illustrated machine, bars of stock are fed into a measuring position and a measuring carriage on which the sensors are mounted is moved to position the sensor with respect to the shear plane at a distance from the stock gauge equal to the length of the piece of stock being measured plus the length of two blanks to be cut from the stock. Thus, the sensor is positioned with respect to the shear plane by a distance determined by the length of the next piece of stock being fed into the machine. The piece of stock is then moved into the feed position in which it engages the sensor and is fed into the machine. The shear of the machine then progressively cuts blanks or workpieces from the forward end of the stock as it is fed to the shear.

After the first piece of stock has been measured and fed into the machine, the subsequent pieces abut the preceding pieces, with the forward end of the subsequent piece of stock engaging the rearward end of the preceding piece. Therefore, during the continuing operation of the machine, wherein the sensor is located by measuring the subsequent piece, the passage of the rearward end of such subsequent piece of stock determines the location of the rearward end of the preceding piece of stock, as well as the forward end of the subsequent piece of stock. Therefore, during normal operation the sensing system determines the location of both ends of the pieces of stock being fed into the machine.

In accordance with the present invention, the proper operation of the cutter to produce satisfactory usable blanks is ensured and a minimum of scrap is produced, since all usable blanks are retained for further processing.

DETAILED DESCRIPTION OF THE DRAWINGS

Figure 3:
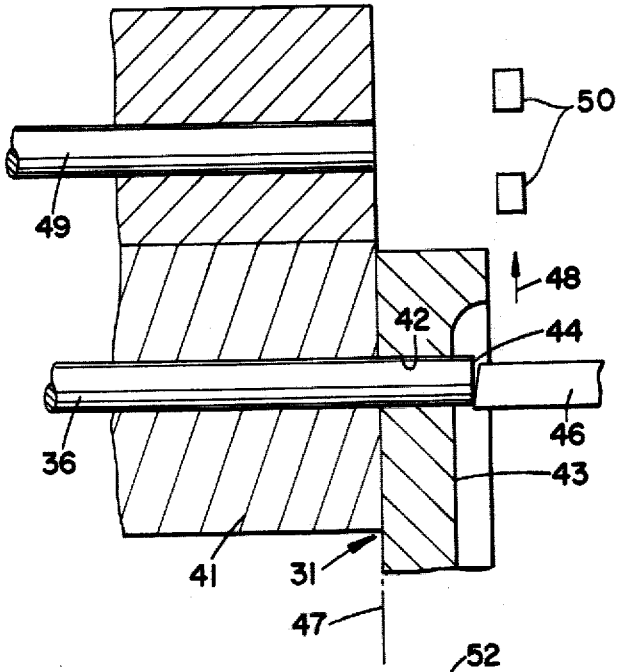
FIG. 3 is an enlarged, fragmentary, schematic view of the shear which is operable to progressively shear blanks or workpieces from the forward end of the piece of stock being fed into the machine for transfer to subsequent working stations.
Figure 3A:
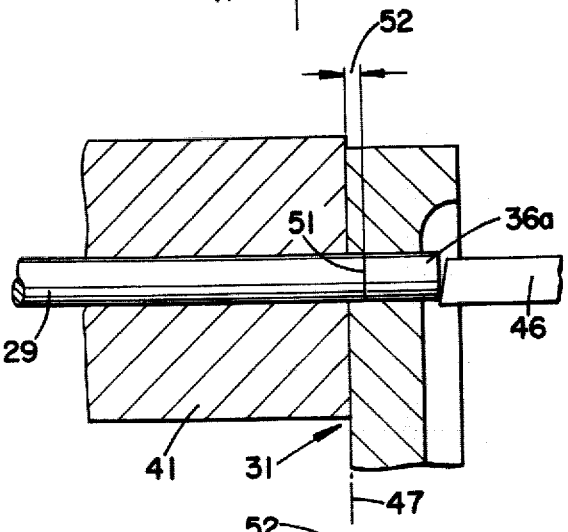
FIG. 3*a* is a fragmentary view similar to FIG. 3, but illustrating a condition which can occur when the rearward end of a first piece of stock reaches the shear and the remaining piece of stock is of a length less than the length of the blank or workpiece required by a relatively small amount.
Figure 3B:
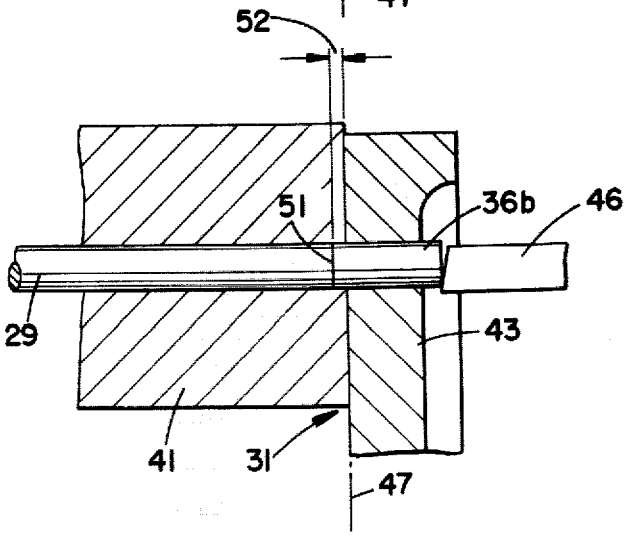
FIG. 3*b* is a fragmentary view similar to FIG. 3*a*, but illustrating a situation existing when the remaining portion of stock exceeds the length of one blank and is substantially less than the length of two blanks.

Reference should first be made to FIGS. 3 through 3*b* for an understanding of the various conditions in which bar end dropping and short feed are required.

FIG. 3 schematically illustrates the shear structure at the completion of the feeding operation but immediately prior to the shearing operation. In such condition, a piece of bar or rod stock 36 extends through a passage in a stationary quill 41 with its forward end projecting through an opening 42 in a cutter 43. The end 44 of the stock engages a stock gauge 46 so that a proper amount of material extends past the shear plane 47 to provide a blank or workpiece of the proper size when such workpiece is sheared along the shear plane 47 from the forward end of the stock 36.

In normal operation, after the stock is seated against the stock gauge, the cutter 43 moves in the direction of the arrow 48, shearing the stock along the shear plane 47 to separate a workpiece from the end of the stock and to carry such workpiece into a position in alignment with a knockout pin 49. While the opening 42 containing the workpiece is in alignment with the knockout pin 49, the knockout pin is operated to move the workpiece axially out of the cutter, where it is gripped by the fingers 50 of a transfer which carries the workpiece to a processing position at which the first operation is usually performed. Reference to U.S. Pat. No. 3,972,211 supra may be made for a description of one type of transfer system with which the present invention may be used. The transfer fingers 51 are operated in timed relation to the operation of the machine and, in normal operation, automatically close on the workpiece as it is ejected by the knockout pin 49.

When, however, the progressive shearing operations proceed to a point where the remaining piece of stock has a length less than the length of the required workpiece, the operating system in accordance with this invention controls the transfer fingers so that they do not close on the piece of stock being ejected by the knockout pin, and such scrap piece is dropped out of the machine in a manner described below.

Referring to FIG. 3*a*, a situation is illustrated in which only a small piece 36*a* of the piece of stock 36 remains, and the forward end of the subsequent piece of stock 29 projects beyond the shear plane. When the forward end of the stock 29 projects a sufficient distance beyond the shear plane 47 to produce a good shearing operation, the cutter is operated to cut a small piece or crop from the forward end of the piece 29 and to transport it with the small piece 36*a* up into alignment with the knockout pin 49. In such instance, the knockout pin ejects the two pieces from the cutter while the transfer fingers 51 remain open, and these pieces of scrap drop out of the machine.

Another condition can occur, as illustrated in FIG. 3*b*. In this instance, the remaining piece 36*b* of the piece of stock 36 is sufficiently long to provide an additional blank and if it projects into the quill 41 a sufficient length to produce a good shearing operation, the shear 43 operates to shear a blank or workpiece and it is transferred by the shear into alignment with the knockout pin 49 and is gripped by the transfer when it is ejected from the shear by the knockout pin. In such instance, however, a small piece of stock remains to the left of the shear plane 47, as viewed in FIGS. 3 through 3*b*, and during the next feeding cycle is pushed forward by the subsequent piece of stock 29 into engagement with the stock gauge 46. After such feeding, a bar end dropping operation essentially as described above in connection with FIG. 3*a* is then performed.

If, however, the spacing between the interface 51 between the two ends of the stock and the shear plane 47 is less than predetermined minimum or critical spacing, designated as 52 in FIG. 3*a* and FIG. 3*b*, a proper shearing operation cannot be performed because the piece of stock projecting beyond the shear plane is of insufficient length to be satisfactorily stabilized and there is a tendency for the blank material to roll and form a burr. Such burr can produce excessive material in the blank, causing overfilling of the dies at subsequent work stations, or can cause difficulty in ejecting the blank from the cutter. The size of the distance 52 below which difficulties occur in shearing varies with the size of the stock and the temperature of the stock. Generally, the minimum critical distance for good shearing increases with both the diameter and the temperature of the stock being sheared, but is also affected by the particular type of material being cut.

In accordance with this invention, the apparatus is arranged to determine if the interface 51 will be spaced from the shear plane 47 by a distance less than the critical shearing distance if normal feeding is continued. If it is determined that insufficient spacing will be provided, the length of the feed stroke is modified to ensure that the interface is outside such critical range. This ensures that satisfactory shearing operations can be achieved. In the illustrated embodiment, this is accomplished by performing one short feed stroke to ensure that the interface is to the left of the position illustrated in FIG. 3*b* whenever normal feeding would have positioned the interface within the critical range. Of course, short feeding causes the end of the preceding piece of stock beyond the shear plane to be of an improper length for a satisfactory blank, so the controls of the machine are arranged to drop the short blank resulting from short feeding. After the short feeding operation, the subsequent normal feed stroke positions the interface at a position to the right of the position of the interface in FIG. 3*a*, so two unacceptable pieces exist, and these are also dropped by the transfer.

Figure 1:
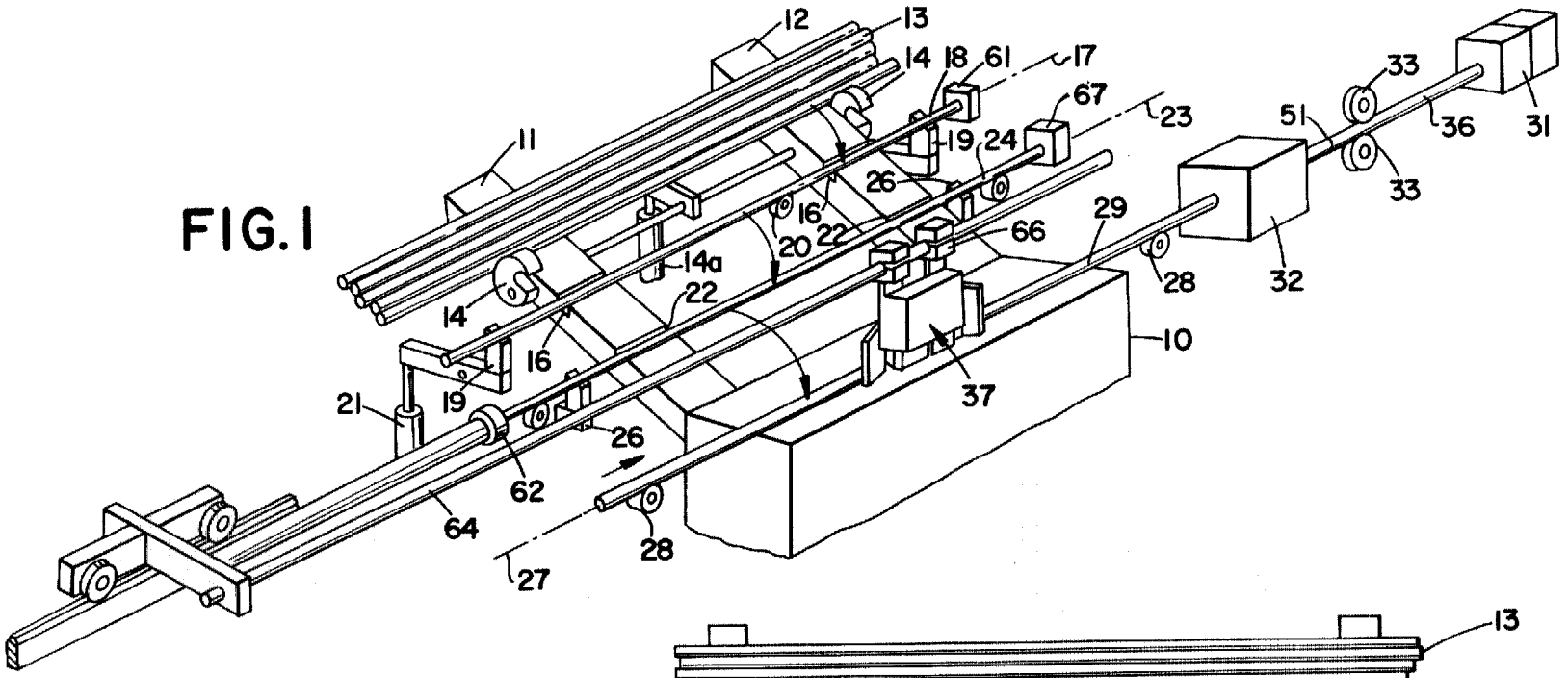
FIG. 1 is a schematic, perspective view of the stock feed system incorporating the present invention and illustrating the manner in which individual pieces of stock are progressively fed into a forging machine.

FIG. 1 schematically illustrates the overall feed system, which includes a frame 10 having upwardly inclined, spaced stock supports 11 and 12. A supply of bars of stock 13 rests on the supports 11 and 12 and against an unscrambler schematically represented at 14. Generally, the pieces of stock in the supply have a relatively uniform length, but are not all of exactly the same length. Therefore, the system according to this invention provides a measuring function, as discussed below.

The unscrambler 14 may be of any suitable known design, and its principal function is to separate a single piece of stock from the supply and to allow such piece to roll down the supports 11 and 12 until it drops into grooves 16 formed in the supports 11 and 12, to provide a holding or ready position along the centerline 17 for a single piece of stock 18. The unscrambler 14 is usually powered by an actuator 14*a*. Located below the piece of stock 18 is a pair of powered rollers 20 which move the piece of stock into engagement with a stop 61 to axially position the piece of stock and a pair of lifters 19 which are pivoted and operated by a piston and cylinder actuator 21 to subsequently lift the piece of stock 18 out of the grooves 16 so it can roll to a measuring position, also formed by grooves 22 formed in the supports 11 and 12. The measuring position extends along the centerline 23.

In FIG. 1 a piece of stock 24 is located in the measuring position for measurement in the manner described below. Here again, a pair of lifters 26 are pivoted and powered by an actuator (similar to the actuator 21 but not illustrated) to lift the piece of stock 24 out of the measuring position so that it can roll to the feed position indicated by the centerline 27. Powered rolls 28 engage a piece of stock 29 at the feed position 27 and operate to move such piece of stock axially toward the shear 31 of a forging machine or the like. Such shear is illustrated only schematically in FIG. 1.

In the illustrated embodiment, a stock heater 32 is provided through which the pieces of stock pass as they move to the shear. Such heater may be of any suitable type known to those skilled in the art for heating stock as it feeds to the machine. Such heaters are usually induction heaters and are used when the forging operations are conducted as either warm forming or hot forming. The invention, however, is also applicable to cold forming wherein the stock is not heated before being processed.

Located between the shear 31 and the heater 32 are the machine feed rolls 33, which grip opposite sides of the stock feeding into the machine and intermittently rotate to feed the stock into the machine in a timed relationship to the operation of the machine. In FIG. 1, a full length of stock 29 is moving along the feed position and is engaging the rearward end of the preceding piece of stock 36 from which blanks or workpieces are being cut by the shear 31 at the interface 51. As workpieces are progressively cut from the forward end of the forward piece of stock 36, such piece of stock is fed forward incrementally by the feed rolls 33. As this occurs, the subsequent piece of stock 29 is advanced by the powered rollers 28 to maintain engagement between the adjacent ends of the two pieces of stock and until the piece of stock 29 passes between the feed rolls 33. After the piece of stock 29 enters the feed rolls, the forward piece 36 is fed by its engagement with the forward end of the stock piece 29.

Positioned adjacent to the piece of stock 29 in the feed position 27 is a sensing assembly 37 which senses the passage of the rearward end of the piece of stock 29 to initiate the bar end dropping operation.

Figure 6:
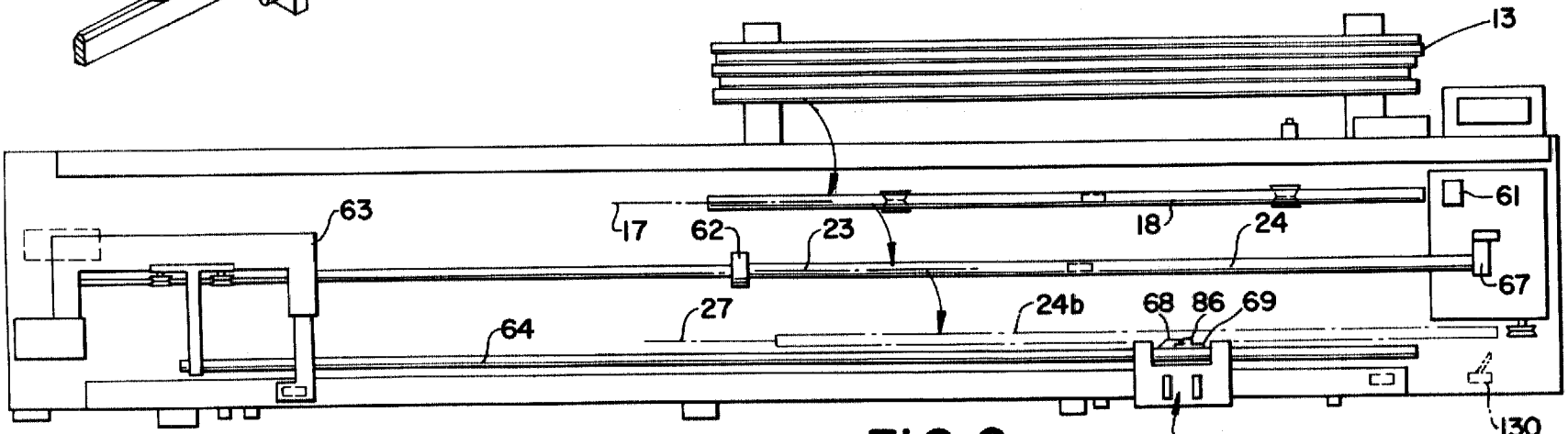
FIG. 6 is a schematic plan view of the stock feed apparatus illustrating the structure for automatically measuring each successive piece of stock as it is fed to the machine for positioning the sensing unit.

Referring now to FIG. 6, as a piece of stock 18 reaches the ready position 17 from the stock supply 13, it is engaged on its underside by powered rollers which move it axially into engagement with a stop 61 so that its axial position, as well a its lateral position, will be consistently established. A piece of stock 24 in the measuring position is engaged on its end by a pusher 62 mounted on a measuring carriage 63 which is supported for retraction and extension along the machine frame by power means, such as a chain drive or a piston and cylinder actuator (not illustrated). Also mounted on the measuring frame 63 is a rod 64 which supports the sensing assembly 37. Clamp means 66, illustrated in FIG. 1, permit the sensing assembly 37 to be adjusted with respect to the bar 64 but locked in adjusted positions.

The measuring carriage 63 is retracted prior to the transfer of the bar 24 from the ready position to the measuring position. The carriage 63 is then moved to the right, as viewed in FIG. 6, to engage the bar 24 and move it into engagement with a measuring stop 67. This positions the sensing assembly 37 with respect to the machine frame at a location which is precisely determined by the length of the piece of stock 24 in the measuring position. For example, if the piece of stock 24 is slightly longer, the position of the sensing assembly will be further to the left, and if the piece of stock 24 is slightly shorter, its position will be further to the right.

After the measuring operation, the piece of stock, which has been previously measured, is ejected from the measuring position and moved to the feed position 27 where it engages two sensing members 68 and 69 provided on the sensing assembly 37. In FIG. 6, the bar 24 is illustrated in phantom at 24*b* after it has been transferred to the feed position 27 and has been moved by the rollers 28 toward the heater. After the bar end dropping function has been initiated by the sensing assembly, it is retracted by the measuring carriage 63 to allow a subsequent bar 18 to be dropped into the measuring position and measured for positioning the sensing assembly while the machine continues to feed the piece of stock previously measured into the cutter.

Referring now to FIGS. 7 through 11, the sensing assembly 37 provides a frame 71 supported by the clamp 66 on the bar 64. The first sensing member 68 is mounted on a lever 72, which is supported on the frame 71 by a pivot 73 for movement between an extended position illustrated in full line in FIGS. 7 and 8 and a retracted position illustrated in phantom in FIG. 8, to which it is moved by the presence of a piece of stock 29 in the feed position.

A spring system is provided to bias the lever 72 to its extended position and includes a bolt 74 pivoted at 76 on the lever 72 and extending through a clearance hole in the frame 71. A spring 77 extends between adjusting nuts 78 and the frame 71, and provides a biasing force urging the lever 72 clockwise to the full line position to extend the sensing member 68. However, when a piece of stock 29 is in the feed position and engaging the sensing member 68, the lever is pivoted against the action of the spring 77 to the phantom line position.

A switch 79 is engaged by an adjusting screw 81 carried by the lever 72 and is operated when the sensing member 68 moves to its full line position as the end of the piece of stock 29 moves past the sensing member 68 and the operation of the switch establishes a signal to indicate such passage of the rearward end of the piece of stock 29 past the sensing member 68.

The second sensing member 69 is mounted on a second lever 82, which is also pivoted on the frame 72 by the pivot 73. Here again, a pivoted bolt 83 and spring 84, best illustrated in FIGS. 7 and 9, bias the second sensing member 69 toward an extended position and allow such lever to move to the phantom line position illustrated in FIG. 10 when the piece of stock 29 engages a projection 86 on the second sensing member 69. Here again, the lever is provided with an adjustable screw 87, which engages and operates a switch 88 when the sensing member 69 is in extended position so that a sensing signal is generated when the end of the piece of stock 29 moves past the projection 86 to allow the sensing member 69 to extend.

Figure 7:
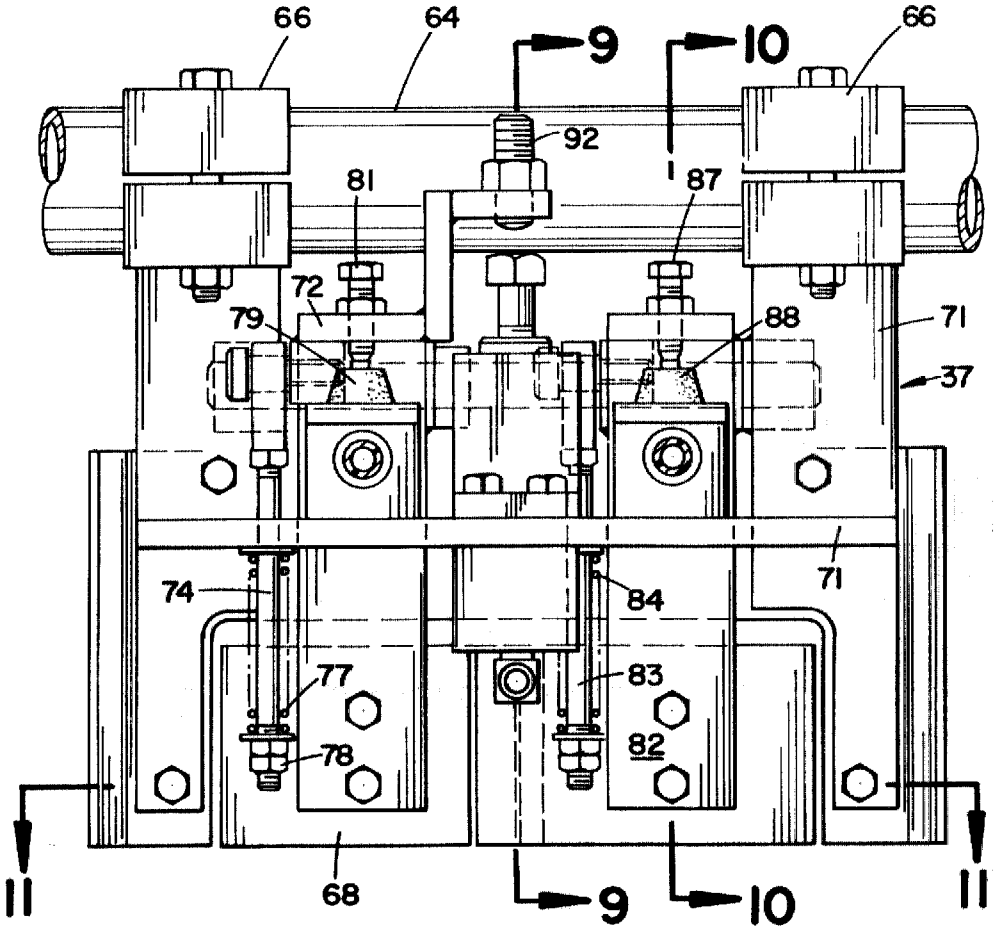
FIG. 7 is an enlarged, fragmentary side elevation of the sensing unit which senses the passage of the rearward end of the piece of stock as it is fed into the machine.
Figure 8:
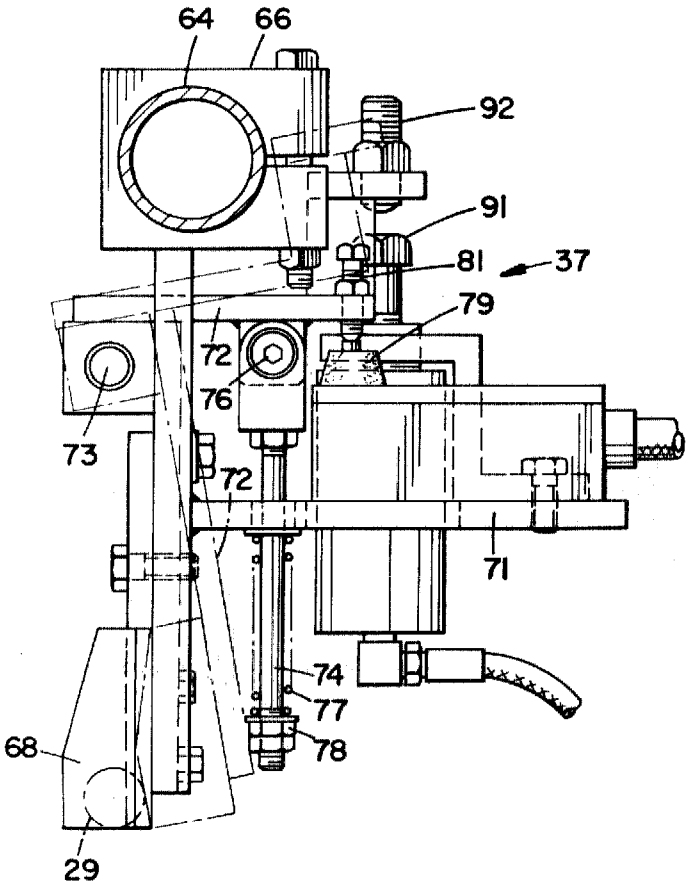
FIG. 8 is a side elevation of the sensing unit illustrated in FIG. 7.
Figure 9:
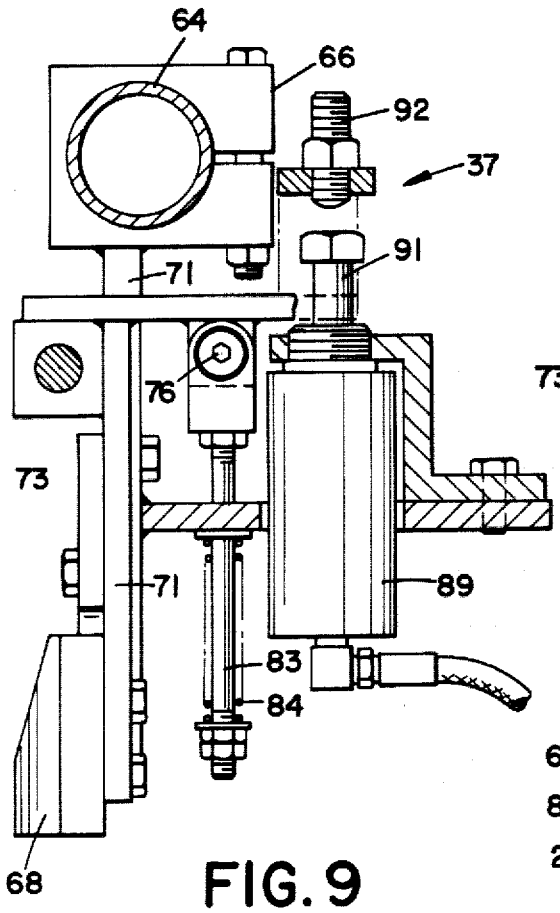
FIG. 9 is a fragmentary section taken along line 9—9 of FIG. 7.
Figure 10:
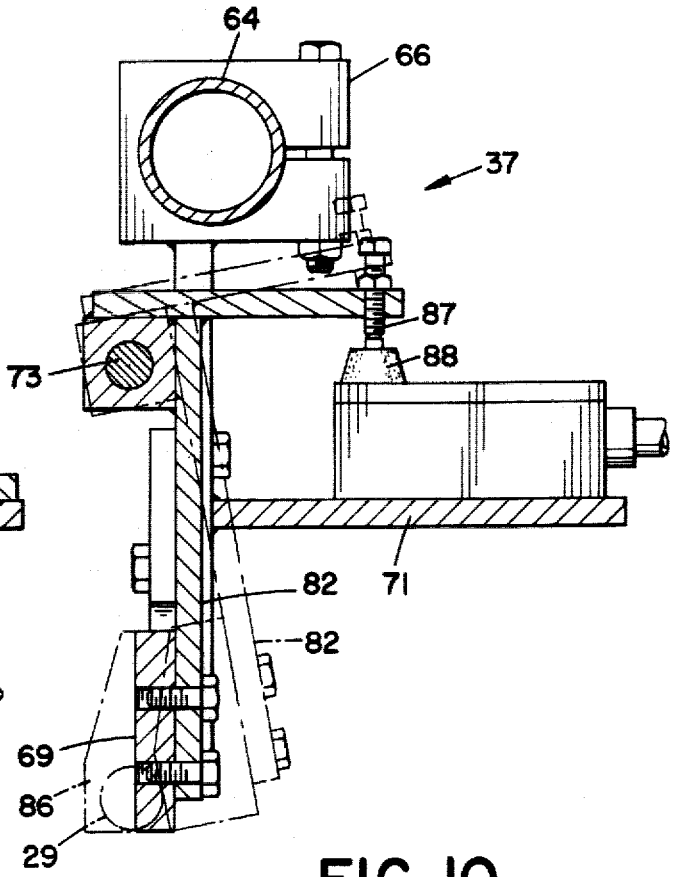
FIG. 10 is a fragmentary section taken along line 10—10 of FIG. 7.
Figure 11:
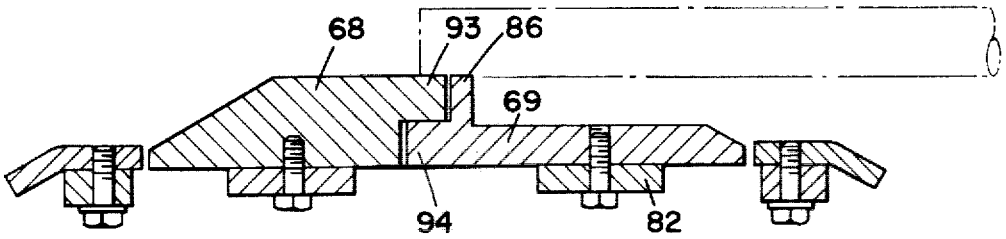
FIG. 11 is a fragmentary section taken along line 11—11 of FIG. 7, with parts removed for purposes of simplified of the drawings.

A mechanism is provided to allow the retraction of both of the sensing members 68 and 69 so that stock can be back-fed out of the machine when required. This mechanism is illustrated in FIGS. 7 and 9, and includes a piston and cylinder actuator 89 having a piston 91 which can be extended into engagement with an adjusting screw 92 carried by the lever 72. As best illustrated in FIG. 11, the sensing member 68 is provided with a laterally projecting portion 93 which overlaps a laterally projecting portion 94 on the sensing member 69 so that retraction of the member 68 also causes the retraction of the member 69.

Figures 2, 12, 13:
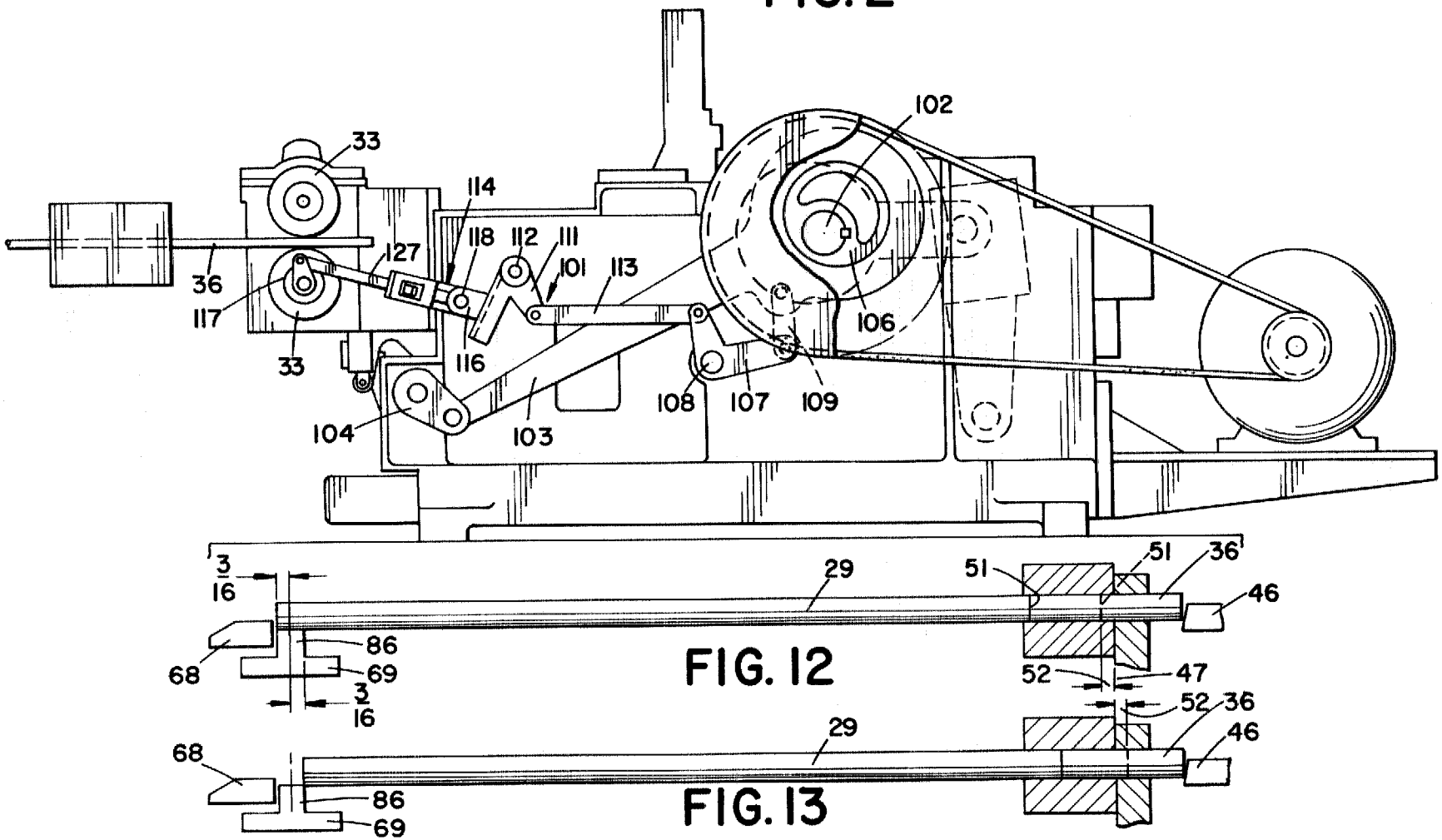
FIG. 2 is a side elevation of a typical forging machine to which the present invention can be suitably applied and which is provided with a short feed system constituting part of the present invention.
FIG. 12 is a schematic view illustrating the operative parts of the sensor and an associated piece of stock being fed to the shear at one extreme condition or position requiring short feed.
FIG. 13 is a schematic view similar to FIG. 12 but illustrating the other extreme position requiring a short feed.
Figure 5:
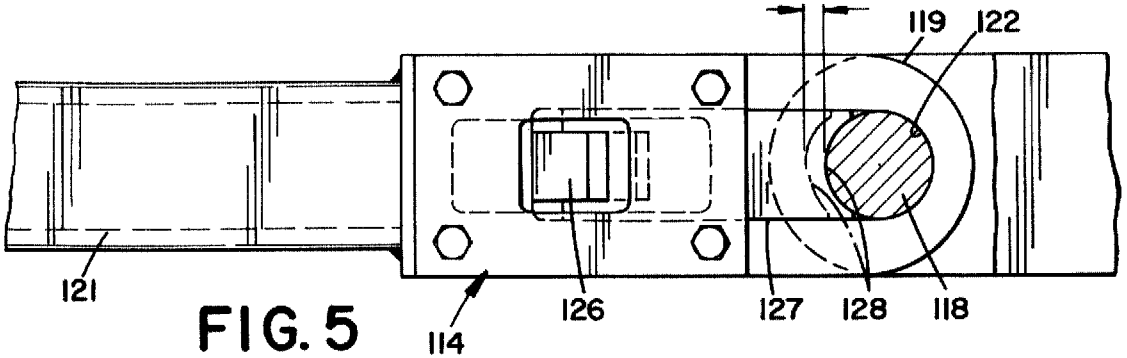
FIG. 5 is a fragmentary side elevation of the short feed mechanism taken along line 5—5 of FIG. 4.
Figure 4:
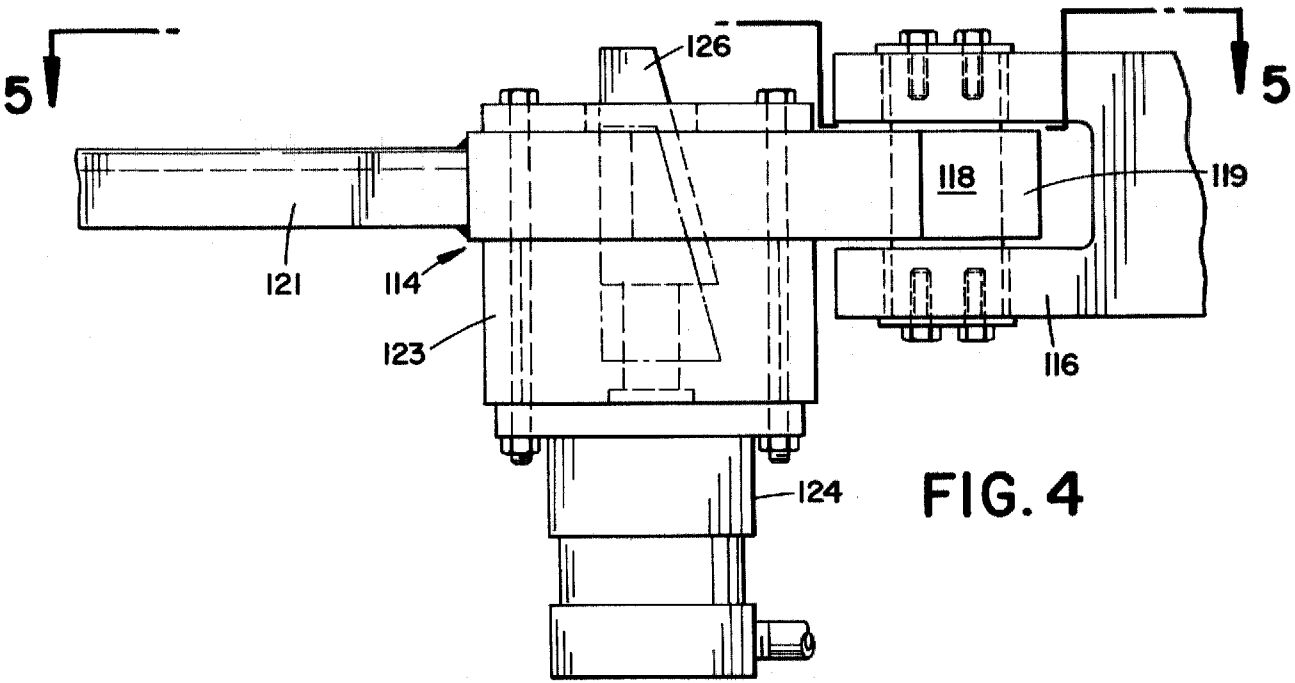
FIG. 4 is an enlarged, fragmentary plan view of the mechanism for establishing a short feed stroke when required.

The short feed mechanism can be best understood by reference to FIGS. 2, 4, and 5. The feed rolls 33 engage opposite sides of a piece of stock 36 being fed into the shear of the machine. Such feed rolls are connected for rotation in opposite directions and are powered for intermittent rotation by a feed roll drive system indicated generally at 101 from the main crank 102 of the machine. The main crank in most forging machines is connected through a pittman to drive a header slide back and forth toward a die breast to perform the various forming operations performed by the machine. A knockout drive lever 103 is connected at one end to the knockout drive power input arm 104 and is connected to an eccentric 106 on the crankshaft 102. Because of the eccentric mounting, the knockout drive lever 103 adjacent to its right end, and as viewed in FIG. 2, moves substantially through a circular path having a vertical component of movement.

The circular movement of the right-hand end of the knockout drive lever 103 is used to power the feed rolls 33 through the linkage, including a rocker arm 107 pivoted at 108 on the machine frame. Oscillating rotation of the rocker arm 107 is produced by a pivoted bar 109 pivoted at one end on the knockout drive lever 103 and at the other end on one leg of the rocker arm 107. This oscillating rotation, which is automatically timed with the operation of the machine through its mechanical connection, is transmitted to a second rocker arm 111 pivoted at 112 on the machine frame through a second drive link or bar 113 which is pivoted at one end on the other leg of the rocker arm 107 and at the other end to a leg of the rocker arm 111. Through this driving connection, the rocker arm 111 is again caused to move at oscillating rotation in a manner timed to the operation of the machine.

A short feed drive assembly 114 is pivoted at one end on a stroke adjusting block 116 and at the other end on an arm 117 connected to drive the feed rolls 33. The drive connection between the arm 117 and the feed rolls includes a one-way clutch system so that the feed rolls can only be rotated by the arm 117 in a direction causing feeding of the piece of stock 36 to the right. The normal adjustment of the stroke of feeding is provided by moving the adjusting block 116 along the arm of the rocker arm 111 toward and away from the pivot 112.

Turning now to FIGS. 4 and 5, the short feed assembly 114 includes a pull pin 118 mounted on the adjusting block 116. A yoke assembly mounted on the end of the drive link 121 extends around the pull pin 118 and provides a semicircular surface 122 which is engaged by the pull pin 118 to cause the feeding rotation of the feed rolls 33. Mounted on the yoke 119 is an actuator support 123 on which is mounted the cylinder 124 of a wedge drive actuator. The actuator 124 is operable to drive a wedge 126 between extended and retracted positions illustrated in FIG. 4. Positioned between the wedge and the pull pin is a sliding block 127 formed with a semicylindrical bearing surface 128 which engages the side of the pull pin 118 opposite the semicylindrical surface 122 and is provided with a mating surface engageable at its other end with the wedge 126.

When the wedge 126 is extended, the sliding block is clamped to the right into engagement with the pull pin 118 to maintain the pull pin in engagement with the surface 122 of the yoke 119. However, when the wedge 126 is retracted, the sliding block 127 can move to the left, as indicated by the phantom position of the end surface 128, to provide lost motion for short feeding.

During normal feed operations, the wedge 126 is in an extended position and there is no lost motion between the pull pin 118 and the yoke 119. Consequently, when the rocker arm 111 is rotated in a clockwise direction, as viewed in FIG. 2, the feed roll drive arm 117 is rotated in an anticlockwise direction through a full arc. In such instance, when the rocker arm 111 thereafter rotates in an anticlockwise direction, the arm 117 rotates through a full arc and causes a full feeding stroke.

When, however, a short feed is required, the wedge 126 is retracted and during the clockwise rotation of the rocker arm 111, the pull pin first moves with lost motion until the sliding block 127 engages the wedge and thereafter moves the feed roll drive lever 117 through an arc which is smaller than the normal feed stroke by the amount of lost motion provided by the retraction of the wedge. Consequently, on a subsequent feed stroke the pull pin, which is initially spaced from the drive surface 122, moves with lost motion through a predetermined lost motion distance and only drives the feed rolls through a lesser than standard stroke. Consequently, the stock 136 in such instance is fed forward through a smaller than normal distance.

The Operation

Assuming for the moment that the machine is operating without heated stock, for example, as a cold former, the initial setup is established as follows. A piece of stock is moved from the supply 13 to the ready position, and from such position into the measuring position. The carriage 63 is then moved forward until the piece of stock 24 is in engagement with both the stop 67 and the measuring plate 62.

The measured piece of stock is then moved into the feed position, where the sensing members 68 and 69 are engaged. With the shear in the stock receiving position, the stock is then moved into the machine until the forward end engages the stock gauge 46. The clamps 66 of the sensing assembly are then loosened and, without moving the measuring carriage, the sensing assembly is adjusted along the support bar 64 until the centerline of the projection 86 of the sensing member 69 is located at a position spaced back from the rearward end of the bar a distance equal to two blank lengths. If the machine is to be used with a stock heater 69, the centerline of the projection 86 is positioned at a location spaced back from the rearward end of the piece of stock by two blank lengths plus a distance equal to the amount that the stock expands during the heating. This expansion length is determined in a manner set forth below.

After the position of the sensing assembly 37 is set, the piece of stock is withdrawn from the cutter any desired distance back along the feed position and the machine is started. As the feed rolls feed the stock forward, the sensing assembly will determine the passage of the rearward end of the piece of stock. Because the piece of stock used to set the sensor assembly 37, namely the first piece of stock, has been moved back a random distance, it is probable that it will not engage the stock gauge 46 at the completion of a given feed stroke, even though it was used to set the machine. Normal feed operation will continue as the forward end of the piece of stock 36 approaches the shear plane 47. The operation of short feed and bar end dropping will proceed in the same manner as if a preceding piece of stock were present, so only the normal feeding with one piece of stock following another will be described in detail.

If the rearward end of a piece of stock moves clear of both sensor members 68 and 69 during a single feed stroke, the two sensing members 68 and 69 will be extended by their associated springs and the two switches 79 and 88 are closed. The closing of the two switches initiates a bar end dropping operation, as described below, but in addition operates the measuring carriage 63 to retract the pusher 62 back to clear the measuring position 23 and to allow the next bar to be dropped into the measuring position from the ready position 17. As soon as the measuring carriage is retracted, the lifters 19 eject the bar from the ready position 17 and it moves into the measuring position. The measuring carriage 63 then moves forward to move the pusher 61 into engagement with the bar 24 at the measuring position and the bar is then moved axially by the pusher into engagement with the stop 67, which stops the carriage. This automatically positions the center of the projection 86 of the sensor member 69 at a distance spaced from the stock gauge 46 equal to the length of the bar 24 plus the length of two blanks. Since the stock gauge is inherently one blank length past the shear plane 47, this automatically positions the center of the projection 86 a distance from the shear plane 47 equal to the length of a piece of stock plus one blank length. If the preceding bar has not as yet cleared the feeding position below the measuring position, a sensing switch 130 operates the controls to retain the measuring bar in the measuring position. However, as soon as the rearward end of the preceding bar clears the switch 130 and the measuring cycle has been completed, a signal is generated to operate the lifters 26 to eject the measured bar 24 so that it moves to the feed position and, in the drawings, becomes the bar designated as 29. The continuously driven rollers 28 then operate to move the bar 29 forward until its forward end engages the rearward end of the preceding bar 36.

As the machine continues to operate to cut blanks from the forward end of the piece of stock 36, the interface 51 of the abutting ends of the two bars moves toward the shear plane 47. This action proceeds until the abutting end 51 approaches the position illustrated in either FIG. 12 or FIG. 13.

If the interface is spaced from the shear plane 47 by a distance greater than illustrated in FIG. 12, the bar will maintain both of the sensing members in their retracted position and normal operation will continue until one or both of the sensing members senses the passage of the rearward end of the piece of stock 29.

If at the end of a given feed stroke the rearward end of the stock moves clear of both of the sensing members 68 and 69, they will extend essentially together and operate both of the switches 79 and 81. This will indicate that the interface 51 between the two pieces of stock is spaced from the shear plane 47 by a distance less than the length of one blank. When both of the switches 79 and 88 are operated for the first time at the completion of a given feed stroke, a signal is generated which is stored in a suitable manner to cause the transfer fingers to function normally at the completion of the next cutter stroke but to remain open at the completion of the subsequent cutter stroke. Therefore, the shear operates to cut the last full blank from the piece of stock 36 and it is gripped by the transfer fingers for transfer to the subsequent operating stations. On the next following feed stroke, however, the interface 51 moves into the cutter portion of the shear along with the first portion of the piece of stock 29. The shear then operates to crop the forward end of the piece of stock 29 and when the two short pieces, one from the piece of stock 36 and one from the piece of stock 29, are ejected from the cutter, the transfer fingers remain open and the short pieces drop out of the machine.

If, however, the sensor assumes a condition as illustrated in either FIG. 12 or 13 at the completion of the given feed operation, only the sensing member 68 extends to operate the switch 79 but the switch 88 is not operated. This situation can occur only if the end of the stock clears the sensor 68 but not the projection 86 on the sensing member 69. This condition determines that after the next feed stroke the interface 51 will be within the critical distance 52 on one or the other sides of the shear plane 47 if normal feeding continues. Since the shear cannot produce a good cut when the interface 51 is within such critical distance of the shear plane, the short feed mechanism described above is operated to retract the wedge 126 so that at the completion of the next feeding stroke, the interface will be located to the left of the dotted line position in FIG. 12, so that a proper cutting operation can be performed.

The short feed, however, will not cause the movement of the remaining part of the piece of stock 36 into engagement with the stock gauge 46 so the piece of stock cut on the next stroke of the cutter is of insufficient length. The control circuit is therefore arranged to cause the transfer fingers to remain open immediately following each short feed to drop the sheared blank out of the machine and to remain open during the subsequent full cycle in which the interface 51 will be located to the right of the shear plane but at a distance spaced therefrom by more than the critical distance. In such subsequent cutting operation, the forward end of the bar stock 29 is cropped and normal dropping of the two pieces occurs. The width of the projection 86 is selected to be equal to at least twice the critical distance 52 and the short feed mechanism is arranged to feed the stock, during a short feed cycle, a distance less than the normal feed stroke by an amount exceeding twice the critical distance 52.

The electrical control circuit has not been illustrated, since it is within the skill of the art to produce the circuit necessary to accomplish the desired function. It is necessary, however, to arrange the control circuit to provide a signal storage function to provide the delayed functions required. This can be done electrically or mechanically. The mechanical storage of the signal information can be accomplished by a rotary cam switch which is connected to the machine drive to rotate at one-half speed so as to initiate controlling functions in response to prior signals to, for example, maintain the transfer fingers open for one or two cycles as required, and to initiate short feeding as required by the signals generated by the sensing assembly 37.

The manner in which the expansion lengths, when the heater 32 is used, can be determined is as follows. A piece of stock is inserted through the heater and the machine run with the fingers open until the blanks being cut from the end of the stock reach the operating temperature required. The machine is then stopped, the heater is turned off, and the location of the rearward end of the piece of stock being fed is quickly determined. The piece of stock is then removed and allowed to cool. Once cooled to room temperature, it is reinserted and the distance between the hot or warm position of its rearward end and its cold rearward end position is noted. This distance is then used in adjusting the machine for similar operations with similar stock material.

In accordance with the present invention, there is no unnecessary scrap, since only unusable pieces of stock are rejected. Further, the invention ensures that sufficient spacing is provided between the ends of the pieces of stock and the shear plane of the cutter to provide a good cutting operation. Further, since the bar end dropping is accomplished automatically, the chance of die damage or jamming because of improperly sized blanks is virtually eliminated.

Although the preferred embodiment of this invention has been shown and described, it should be understood that various modifications and rearrangements of parts may be resorted to without departing from the scope of the invention as disclosed and claimed herein.

What is claimed is:

1. A cyclically operable machine for shearing blanks from a piece of stock, comprising a shear having a shear plane and operable to sequentially cut blanks of measured length from the forward end of a piece of stock during each cycle, a transfer operable to sequentially transfer blanks from said shear to a subsequent processing station during each cycle, a feeder intermittently operable to feed pieces of stock to said shear during each cycle, and sensing means including a sensor operable to determine the cycle when the portion of the end of a piece of stock within said shear beyond said shear plane is of insufficient length to produce a full blank and operable to cause said transfer to reject said portion after it is sheared, said sensing means being operable to establish when normal feeding would position the end of a piece of stock a predetermined distance from said shear plane which is insufficient to provide a satisfactory shearing operation and is operable to modify the distance through which said feed operates to ensure that said one end is spaced from said shear plane a sufficient distance to provide a satisfactory shearing operation, said sensor causing said transfer to reject two pieces on two cycles of operation of said shear when the operation of said feed is modified.

2. A machine as set forth in claim 1, wherein said sensor operates to sense the passage of the rearward end of a piece of stock.

3. A machine as set forth in claim 2, wherein said feed operates to sequentially feed separate pieces of stock, and said sensor includes means operable to position said sensor a distance from said shear plane which is determined by the length of the piece of stock being fed.

4. A machine as set forth in claim 2, wherein said feed operates to sequentially feed separate pieces of stock, and said sensor includes measuring means to measure each piece of stock being fed and to position said sensor a distance from said shear plane which is determined by the length of each piece of stock being fed.

5. A machine as set forth in claim 4, wherein said sensor includes two sensing members, passage of the rearward end of a piece of stock past both of said sensing members during a given feed stroke causing said transfer to reject during one cycle without modifying said feed, passage of said rearward end past one of said sensing members but not past the other of said sensing members during a given feed stroke causing said sensing means to modify the distance through which said feed operates.

6. A cyclically operable machine for shearing blanks from a piece of stock, comprising a shear having a shear plane and operable to sequentially cut blanks of measured length from the forward end of a piece of stock during each cycle, a transfer operable to sequentially transfer blanks from said shear to a subsequent processing station during each cycle, a feeder intermittently operable to feed pieces of stock to said shear during each cycle, and sensing means including a sensor operable to determine the cycle when the portion of the end of a piece of stock within said shear beyond said shear plane is of insufficient length to produce a full blank and operable to cause said transfer to reject said portion after it is sheared, said feed operating to sequentially feed separate pieces of stock, and said sensor including means operable to position said sensor a distance from said shear plane which is determined by the length of the piece of stock being fed.

7. A cyclically operable machine for shearing blanks from a piece of stock, comprising a shear having a shear plane and operable to sequentially cut blanks of measured length from the forward end of a piece of stock during each cycle, a transfer operable to sequentially transfer blanks from said shear to a subsequent processing station during each cycle, a feeder intermittently operable to feed pieces of stock to said shear during each cycle, and sensing means including a sensor operable to determine the cycle when the portion of the end of a piece of stock within said shear beyond said shear plane is of insufficient length to produce a full blank and operable to cause said transfer to reject said portion after it is sheared, said feed operating to sequentially feed separate pieces of stock and said sensing means including measuring means to measure each piece of stock being fed and to position said sensor a distance from said shear plane which is determined by the length of each piece of stock being fed.

8. A machine for shearing blanks from elongated pieces of stock comprising a shear operable to cut blanks along a shear plane from the forward end of a length of stock, feed means operable to sequentially and intermittently feed pieces of stock to said shear, sensing means operable to determine the location of the rearward end of a piece of stock as the forward end approaches such shear plane, and measuring means operable to sequentially measure the length of each piece of stock and to locate said sensing means at a position spaced from said shear plane a distance equal to the length of a piece of stock being fed to such shear plus a first predetermined distance, said sensing means being connected to said feed means and in cooperation therewith operating to modify the distance said pieces of stock are fed forward to prevent the forward end thereof from being positioned within a second predetermined distance on either side of said shear plane.

9. A machine as set forth in claim 8, wherein said machine includes a transfer operable to transfer blanks from said shear to a subsequent processing station, and said sensing means operates to cause said transfer to reject blanks of nonstandard lengths.

10. A machine for shearing blanks from elongated pieces of stock comprising a shear operable to sequentially cut blanks from the forward end of a piece of stock along a shear plane, and feed and control means operable to intermittently feed pieces of stock to such shear and to prevent the forward end of each piece of stock from being located within a first predetermined distance of either side of said shear plane, said feed and control means including a feed normally operable to intermittently feed pieces of stock toward said shear plane through a second predetermined distance and being operable on a signal to feed such stock through a distance different from said second predetermined distance by an amount greater than twice said first predetermined distance, said feed and control means also including sensing means spaced from said shear plane and positioned therefrom a distance equal to the length of a piece of stock plus a third predetermined distance, said sensing means operating to measure each piece of stock as it is supplied to said feed means and to position said sensing means at the required distance from said shear plane.

11. A machine as set forth in claim 10, wherein said machine includes transfer means operable to grip a blank from said shear and to transfer said blank to a location spaced from said shear, said sensing means preventing said transfer from gripping blanks cut from a piece of stock when the forward end portion of a piece of stock projects beyond said shear plane by a distance less than the distance required to produce a normal blank.

12. A feed system for forging machines or the like, comprising a cutter having a shear plane and operable to shear blanks from stock so long as the end of said stock is spaced from said shear plane by at least a predetermined distance, stock feed means operable to feed separate elongated pieces of stock to said cutter, said cutter operating sequentially to cut blanks of predetermined lengths from the forward end of said stock, and said feed means operating after each blank is cut to advance said stock to said cutter to position said forward end for a subsequent cut, said feed means providing a sensor operable to sense the passage of the rearward end of the piece of stock and positioning means operable to position said sensor a distance from said cutter related to the length of a piece of stock being fed by said feed means, said sensor operating to determine if the forward end of the piece of stock being fed will with normal feeding be within said predetermined distance from said shear plane and operating to alter the length of feed to prevent said forward ends from being positioned within said predetermined distance.

13. A feed system as set forth in claim 12, wherein said sensor includes two sensing members engageable with a piece of stock being fed to said cutter, one of said sensing members having a projection engaging said stock with said projection having a width in the direction of stock movement equal to about twice said predetermined distance.

14. The method of operating a forging machine or the like having a stock feed and a shear cooperating to sequentially cut measured blanks from separate pieces of stock and for rejecting unsatisfactory blanks produced at the ends of said stock, comprising measuring the length of successive lengths of stock to position a sensor, sensing the passage of the rearward end of each piece of stock to establish when an unsatisfactory blank will be produced, and rejecting unsatisfactory blanks based upon said sensing.

15. A method as set forth in claim 14, wherein the passage of the rearward end of the piece of stock is used to determine when uniform feeding will position the forward end of said piece of stock an insufficient distance from the shear plane of the shear for satisfactory cutting, and thereupon modifying the feed stroke to ensure that the forward end of the piece of stock will be a sufficient distance from said shear plane to provide a satisfactory cut.

16. A method as set forth in claim 15, wherein the sensing of the passage of the rearward end of the piece of stock also determines if the rearward end of the preceding piece of stock will be too close to said shear plane to provide satisfactory cutting and to thereupon modify the stroke to ensure that the rearward end of the preceding piece of stock will also be a sufficient distance from said shear plane to provide a satisfactory cut.

* * * * *